US011242723B2

(12) United States Patent
Pedraza et al.

(10) Patent No.: US 11,242,723 B2
(45) Date of Patent: Feb. 8, 2022

(54) FRAC BALL DISPENSER

(71) Applicant: C&J Spec-Rent Services, Inc., Houston, TX (US)

(72) Inventors: Jaime C. Pedraza, Cypress, TX (US); Vanessa M. Reyes, Houston, TX (US); Kevin J. Zanca, Houston, TX (US); Bulent Finci, Sugarland, TX (US); George M. Innes, Houston, TX (US)

(73) Assignee: Nextier Completion Solutions Inc., Houston, TX (US)

( * ) Notice: Subject to any disclaimer, the term of this patent is extended or adjusted under 35 U.S.C. 154(b) by 37 days.

(21) Appl. No.: 16/418,188

(22) Filed: May 21, 2019

(65) Prior Publication Data

US 2019/0360296 A1 Nov. 28, 2019

Related U.S. Application Data

(60) Provisional application No. 62/676,316, filed on May 25, 2018.

(51) Int. Cl.
*E21B 33/068* (2006.01)

(52) U.S. Cl.
CPC ..... *E21B 33/068* (2013.01)

(58) Field of Classification Search
CPC ..... E21B 33/068; E21B 33/12; E21B 43/26
See application file for complete search history.

(56) References Cited

U.S. PATENT DOCUMENTS

| | | | | |
|---|---|---|---|---|
| 1,961,193 | A * | 6/1934 | Brumbaugh | B60P 1/26 298/22 P |
| 3,039,531 | A * | 6/1962 | Scott | E21B 33/068 166/70 |
| 3,086,587 | A * | 4/1963 | Zandmer | E21B 33/138 166/284 |
| 4,132,243 | A | 1/1979 | Kuus | |
| 4,268,932 | A | 5/1981 | Hogan | |
| 5,709,266 | A * | 1/1998 | Kruse | B65G 47/1478 137/268 |
| 6,588,501 | B1 * | 7/2003 | Boyadjieff | E21B 21/08 166/75.15 |
| 7,234,525 | B2 * | 6/2007 | Alves | E21B 33/068 166/310 |
| 8,869,882 | B2 | 10/2014 | McGuire et al. | |
| 9,109,422 | B2 | 8/2015 | Ferguson et al. | |
| 9,222,329 | B2 | 12/2015 | McGuire et al. | |
| 2008/0029262 | A1 * | 2/2008 | Claxton | F16L 55/46 166/75.15 |
| 2010/0147866 | A1 | 6/2010 | Witkowski et al. | |
| 2013/0228326 | A1 | 9/2013 | Griffith et al. | |
| 2015/0000901 | A1 | 1/2015 | Guidry et al. | |
| 2015/0114323 | A1 | 4/2015 | Hatten et al. | |

(Continued)

*Primary Examiner* — David Carroll

(74) *Attorney, Agent, or Firm* — Egan, Enders & Huston LLP.

(57) ABSTRACT

Frac ball dispensers as well systems and methods employing such are disclosed. Configurations for remotely moving the frac ball dispensers in the vicinity of an open wellhead as well as remotely activating and verifying the dispensement of frac balls from the dispensers into the open wellhead are specifically provided. Configurations of frac ball dispensers to control access to frac balls therein as well as the dispensement of frac balls therefrom are also provided.

20 Claims, 2 Drawing Sheets

(56) References Cited

U.S. PATENT DOCUMENTS

| | | | | |
|---|---|---|---|---|
| 2017/0022777 | A1* | 1/2017 | Allen | E21B 34/02 |
| 2017/0051572 | A1 | 2/2017 | Penney et al. | |
| 2019/0085657 | A1* | 3/2019 | Allen | E21B 34/02 |

* cited by examiner

FRAC BALL DISPENSER

PRIORITY CLAIM

The present application claims priority to U.S. Provisional Application No. 62/676,316 filed May 25, 2018, which is incorporated by reference herein.

BACKGROUND OF THE INVENTION

1. Field of the Invention

This invention generally relates to frac ball dispensers and, more specifically, to frac ball dispensers for dropping frac balls into open wellheads as well systems and methods employing such.

2. Description of the Related Art

The following descriptions and examples are not admitted to be prior art by virtue of their inclusion within this section.

Processes for plugging and perforating a wellbore typically include introducing a ball (commonly called a frac ball) into the wellbore to isolate a stage of newly formed perforations in the wellbore below. In particular, a frac ball that is sized to seat in the plug that defines the end of the stage is dropped into the wellbore. Once the frac ball is seated in the plug, proppant and fluid is introduced into the wellbore to create hydraulic fractures extending from the newly formed perforations. More specifically, the ball blocks the proppant and fluid from flowing to deeper portions of the wellbore and forces them into the newly formed perforations causing the fractures. In some cases, an individual is raised on a lift to the wellhead to physically drop the frac ball into the wellhead, a process which is both dangerous and cumbersome. In particular, there is typically pressure equipment near the wellhead presenting potential harm to the individual. In addition, the process of perforating a wellbore is an iterative process of perforating each stage, dropping a frac ball to isolate the stage and then creating the hydraulic fracture therein. Thus, having an individual physically perform the task of dropping the frac ball is repetitive and time consuming. As a replacement to such a manual process, systems have been developed to introduce frac balls into the wellbore via pressurized lines. If such a system is used in conjunction with an automated wellhead connection assembly, the potential of harm to individuals is drastically reduced since the need to have an individual present at the wellhead is eliminated. The systems, however, are generally complicated, costly and time consuming since they involve the introduction of a frac ball in a pressurized line.

Therefore, it would be advantageous to develop methods and systems for introducing frac balls into wellbores, particularly methods and systems which are safer, more efficient and/or cheaper relative to conventional techniques.

SUMMARY OF THE INVENTION

The following description of various embodiments of systems, devices and methods is not to be construed in any way as limiting the subject matter of the appended claims.

Frac ball dispensers as well systems and methods employing such are disclosed. Configurations for remotely moving the frac ball dispensers in the vicinity of an open wellhead as well as remotely activating and verifying the dispensement of frac balls from the dispensers into the open wellhead are specifically provided. In addition, configurations of frac ball dispensers to control access to frac balls therein as well as the dispensement of frac balls therefrom are also provided.

BRIEF DESCRIPTION OF THE DRAWINGS

Other objects and advantages of the invention will become apparent upon reading the following detailed description and upon reference to the accompanying drawings in which.

Figure 1:
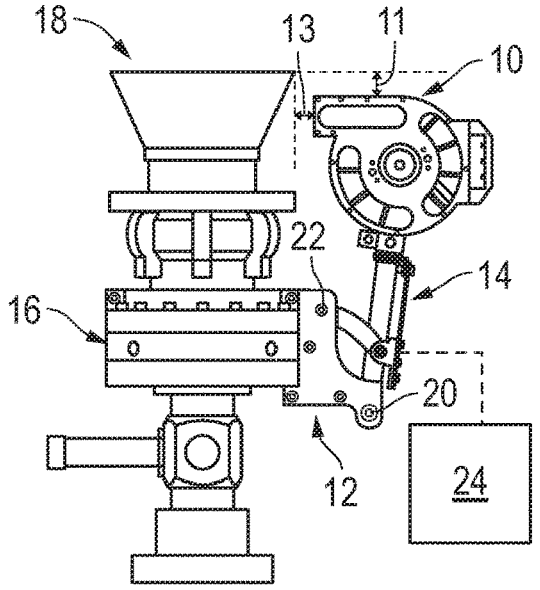
FIG. 1 is a cross-sectional schematic diagram of a frac ball dispenser system mounted to a casing of a wellhead in a stand-by position.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Figure 2:
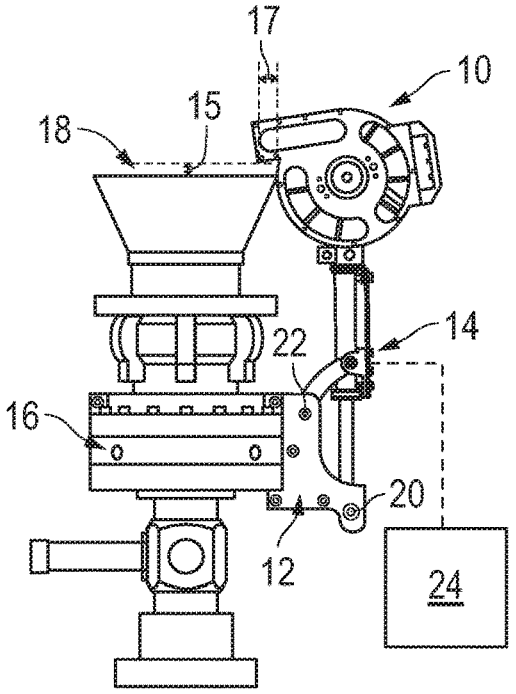
FIG. 2 is a cross-sectional schematic diagram of the frac ball dispenser system depicted in FIG. 1 in a dispensing position.

Turning to the drawings, FIGS. 1 and 2 illustrate an example of a frac ball dispenser mounted to a casing of a wellhead in a stand-by position and in a dispensing position, respectively. More specifically, FIGS. 1 and 2 illustrate frac ball dispenser 10 mounted to a casing of a wellhead via mount 12 and displacement mechanism 14, the latter of which is coupled between frac ball dispenser 10 and mount 12. As will be described in more detail below, frac ball dispenser 10, mount 12 and displacement mechanism 14 together with control system 24 for moving frac ball dispenser 10 between its stand-by and dispensing positions are part of a system for remotely activating and verifying the dispensement of frac balls into an open wellhead.

As shown in FIGS. 1 and 2, mount 12 may, in some embodiments, be coupled to wellhead connection assembly 16, which in turn is coupled to a casing of a wellhead. In general, wellhead connection assembly 16 is configured to securely connect equipment to the wellhead. An example of a wellhead connection assembly is Riglock™ provided by FHE of Fruita, Colo., but other types of wellhead connection assemblies may be considered. In any of such cases, the top of the wellhead connection assembly (such as the funnel shaped component shown in FIGS. 1 and 2) may be referred to herein as the wellhead opening since that is the location where equipment will be inserted for processing. In other embodiments, a wellhead may not include a wellhead connection assembly and, in such cases, mount 12 may be coupled directly to the casing of the original wellhead.

As shown in FIG. 1, frac ball dispenser 10 may be disposed at an elevation below wellhead opening 18 when the dispenser is in a stand-by position. Such a position is advantageous for preventing damage to frac ball dispenser 10 when equipment (such as but not limited to a perforation gun line) is being connected to the wellhead. In some cases, an elevational difference between the top of frac ball dispenser 10 and wellhead opening 18, which is depicted by double arrowed line 11 in FIG. 1, may be at least 2 inches when the frac ball dispenser is in the stand-by position in order to insure sufficient clearance between the wellhead opening and the dispenser in the stand-by position, but smaller elevational differences may be considered. As further shown in FIG. 1, frac ball dispenser 10 may, in some embodiments, be spaced apart from the casing of the wellhead when the dispenser is in a stand-by position and, more specifically, frac ball dispenser 10 may be spaced apart from a vertical plane comprising an upper rim of wellhead opening 18. Such a spacing is advantageous for preventing frac ball dispenser 10 from colliding with the wellhead when it is moved to its dispensing position above wellhead opening 18. In some embodiments, the spacing between a side of frac ball dispenser 10 facing the well head and a vertical plane comprising an upper rim of wellhead opening 18, which is depicted by double arrowed line 13 in FIG. 1, may be at least 2 inches when the frac ball dispenser is in the stand-by position in order to insure sufficient clearance between the wellhead and the dispenser in the stand-by position, but smaller spacings may be considered. In yet other embodiments, frac ball dispenser 10 may be in contact with a portion of the wellhead casing below wellhead opening 18 in its stand-by position.

As shown in FIG. 2, an upper portion of frac ball dispenser 10 may be disposed at an elevation above wellhead opening 18 when the frac ball dispenser is in a dispensing position. In general, frac ball dispenser 10 should be disposed at a high enough elevation such that a bottommost portion of an outlet of the dispenser is disposed at an elevation above wellhead opening 18. In some cases, an elevational difference between the bottommost portion of an outlet of of frac ball dispenser 10 and wellhead opening 18, which is depicted by double arrowed line 15 in FIG. 2, may be at least 1 inch when the frac ball dispenser is in the dispensing position, but smaller elevational differences may be considered. In some cases, it may be advantageous to have at least a portion of the outlet of frac ball dispenser 10 extend over wellhead opening 18 when the dispenser is in the dispensing position to ensure a frac ball dispensed therefrom is deposited in the wellhead. The amount of lateral overreach of the outlet of frac ball dispenser 10 inward from the vertical plane comprising the rim of wellhead opening 18, which is depicted by double arrowed line 17 in FIG. 2, may, in some embodiments, be at least 1 inch, but smaller amounts of overreach may be considered.

To facilitate the movement of frac ball dispenser 10 between its stand-by and dispensing positions, displacement mechanism 14 is coupled between frac ball dispenser 10 and mount 12. Displacement mechanism 14 may be any actuator known in the art used to move a device. It may be energized by electric current, hydraulic pressure or pneumatic pressure. In general, displacement mechanism 14 may be configured to displace frac ball dispenser 10 upward and downward such that the dispenser may be moved from an elevation below wellhead opening 18 to an elevation above wellhead opening 18 and back again. In some cases, displacement mechanism 14 may be additionally configured to move frac ball dispenser 10 in a direction to be closer to a side of the wellhead such that at least a portion of the outlet of frac ball dispenser 10 extends over wellhead opening 18 when it is in its dispensing position. Likewise, in such cases, displacement mechanism 14 may be configured to move frac ball dispenser 10 in a direction away from the side of the wellhead to prevent frac ball dispenser 10 from colliding with the rim of the wellhead when it is being moved back to its stand-by position.

In some embodiments, displacement mechanism 14 may be configured to make such lateral movements of frac ball dispenser 10 as the frac ball dispenser is respectively moved upward and downward such that the movement of frac ball dispenser is essentially one distinct movement as it is moved upward or downward. In particular, displacement mechanism 14 may be configured to move frac ball dispenser 10 in a direction to be closer to a side of the wellhead as the frac ball dispenser is moved upward and, furthermore, may be configured to move frac ball dispenser 10 in a direction away from the side of the wellhead as the frac ball dispenser is moved downward. In some cases, such movements may be referred to as camming motions. An example of configurations which may be used to facilitate camming motions may be pivotable connections (a.k.a., mechanical linkages) 20 and 22 between displacement mechanism 14 and mount 12, but other configurations may be considered.

In yet other embodiments, displacement mechanism 14 may be configured to make multiple distinct movements of frac ball dispenser 10 as it is moved toward or away from its dispensing position. For instance, displacement mechanism 14 may be configured to first move frac ball dispenser 10 in a substantially vertical direction a set distance and then move the frac ball dispenser in a substantially horizontal manner when moving the frac ball dispenser to its dispensing position and then reverse such movements when retracting the frac ball dispenser back to its stand-by position. In yet other embodiments, as noted above, frac ball dispenser 10 may be in contact with a portion of the wellhead casing below wellhead opening 18 for its stand-by position. In such cases, displacement mechanism 14 may be configured to first move frac ball dispenser 10 outward from the wellhead casing a set distance in a substantially horizontal direction and then move the frac ball dispenser in a substantially diagonal manner (or alternatively, move the frac ball dispenser first in a substantially diagonal direction and then a substantially horizontal direction) to its dispensing position and then reverse such movements when retracting the frac ball dispenser back to its stand-by position at the wellhead casing. Other combinations of distinct movements may be considered as well.

As noted above, frac ball dispenser 10, mount 12 and displacement mechanism 14 are part of a system for remotely activating and verifying the dispensement of frac balls into an open wellhead. The remote activation is facilitated by control system 24 shown in communication with displacement mechanism 14 by a dotted line in FIGS. 1 and 2. The communication link between control system 24 and displacement mechanism 14 may be voltage, current, electromagnetic signals, pneumatic pressure, or hydraulic pressure. Furthermore, the communication link between control system 24 and displacement mechanism 14 may be wired or wireless. In general, control system 24 is remotely disposed from the vicinity of the wellhead to which frac ball dispenser 10 is attached such that displacement mechanism 14 may be activated without having to put an individual near the wellhead. An example of a distance that control system 24 may be considered a safe distance from the wellhead may be at least 50 feet, but smaller distances may be considered. In some cases, the determination to activate displacement mechanism 14 at control system 24 may be manual. In other cases, the determination to activate displacement mechanism 14 at control system 24 may be automated, such as in response to a signal indicating perforation guns have been removed from the wellbore and the wellhead is open. In any case, the input entered at control system 24 to activate displacement mechanism 14 may be a mechanical, electrical or facilitated by software. For example, control system 24 may include a hydraulic pump in embodiments in which hydraulic pressure is used to activate and move displacement mechanism 14.

Details regarding the configuration of frac ball dispenser 10 for storing and dispensing frac balls therefrom are described in more detail below in reference to FIGS. 3-5. It is noted, however, although the systems and methods disclosed herein are emphasized for use with the frac ball dispenser configuration described in reference to FIGS. 3-5, the systems and methods may be used in conjunction with frac ball dispensers of other configurations. In particular, the system described in FIGS. 1 and 2 as well as the method of use of such a system are not limited for use with a frac ball dispenser having a rotary element for storing and dispensing frac balls. For instance, the systems and methods described herein may alternatively be used with a frac ball dispenser which stores a stack of frac balls and has an articulating arm for individually picking up a frac ball from the stack and dispensing the selected frac ball from the dispenser. Other alternative configurations may be considered as well.

Figure 3:
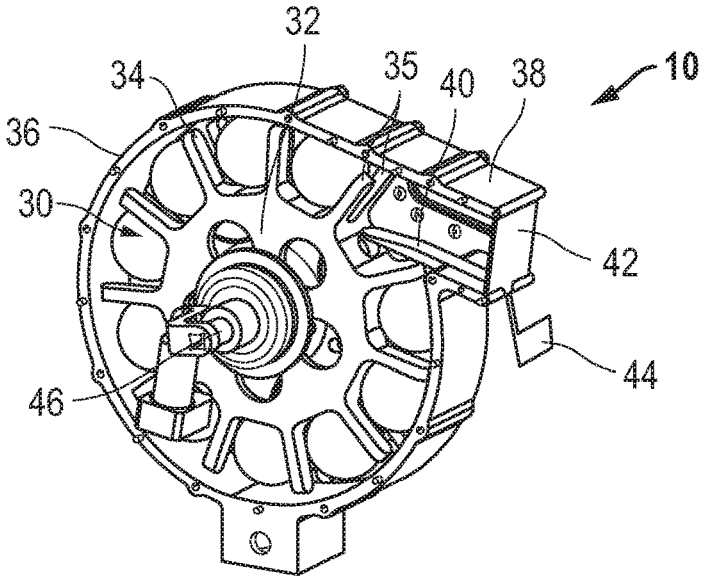
FIG. 3 is an isometric view of an example of a frac ball dispenser with one of its side casings missing.

FIG. 3 illustrates an isometric view of an example of a frac ball dispenser with one of its side casings missing such that interior configurations of the dispenser can be explained. As shown in FIG. 3, frac ball dispenser 10 may include rotary element 30 including hub 32 and a plurality of partitions 34 extending radially from an outer periphery of the hub. Neighboring partitions with respect to the circumference of hub 32 are spaced to accommodate a frac ball of a given size, the spacing of which may be referred to herein as a "bay". In particular, the spacings between neighboring partitions are sufficient such that a frac ball of a given size may be easily accommodated against the circumference of hub 32. In addition, the spacings between neighboring partitions may be sufficient such that a frac ball of a given size may be accommodated between the neighboring partitions with a tolerance of at least 5 mm on either or both sides of the ball relative to the partitions in which the ball is nested, but smaller tolerances may be used. Such spacing configurations allow frac balls to fit within rotary element 30 interior to housing 36 which encases the rotary element. Furthermore, such spacing configurations allow frac balls to be easily and quickly loaded into the frac ball dispenser without having to apply a substantial force to the balls. In general, the tolerance afforded in each bay of rotary element 30 will depend on the size of frac ball placed in the bay.

In some cases, the spacings between neighboring partitions (i.e., the bays of rotary element 30) may be sufficient such that a frac ball of a given size may be accommodated between the neighboring partitions with a tolerance of less than 1.5 cm on either side of the ball relative to the partitions in which the ball is nested. In particular, such a configuration may reduce the amount of movement of the frac ball within the dispenser, reducing the likelihood of damage to the ball. Furthermore, such a configuration may increase the number of frac balls which may be accommodated within a frac ball dispenser of a given size, reducing the number of times the dispenser needs to be loaded. It is noted that the configuration of rotary element 30 to have a particular maximum tolerance on either side of a frac ball disposed between neighboring partitions will be dependent on the size of the ball and, thus, in some cases, rotary element 30 as well as frac ball dispenser 10 may be referenced as being configured to accommodate a particular size of frac balls. In other embodiments, rotary element 30 and frac ball dispenser 10 may not be referenced to such specificity. Rather, rotary element 30 and frac ball dispenser 10 may be referenced as being configured to accommodate a range of frac ball sizes. In general, frac ball dispenser 10 may be configured to accommodate frac balls of any size. Frac balls generally range in diameter from approximately 1 inch and approximately 5 inches and, thus, in some embodiments, neighboring partitions may be spaced such that a distance between midpoints of the neighboring partitions along the length of the neighboring partitions is between approximately 1 inch and approximately 5 inches. Smaller or larger spacings, however, may be considered if a dispenser for smaller or larger frac balls is desired.

In some cases, frac ball dispenser 10 may be configured to accommodate frac balls of a single size. In such embodiments, the spacings between neighboring partitions of rotary element 30 (i.e., the bays of rotary element 30) may be the same. As a result, partitions 34 may be uniformly arranged around the circumference of hub 32. In other embodiments, a plug and perforation process may be performed with progressively larger frac balls for each stage and, thus, frac ball dispenser 10 may be configured to accommodate frac balls of different sizes. In some cases, the bays of rotary element 30 may be progressively larger along the circumference of hub 32 (i.e., starting from the narrowest bay of the rotary element). As a result, partitions 34 may not be uniformly arranged around the circumference of hub 32. In either case, housing 36 may be of any shape and, thus, is not restricted to the circular configuration illustrated in FIGS. 1-5. The circular configuration of frac ball dispenser 10, however, offers an advantage of optimizing ball capacity while minimizing the footprint of the dispenser.

In any case, each of the plurality of partitions 34 may, in some embodiments, include a set of prongs 35 as shown in FIG. 3. The spacing between the prongs may be sufficient to enable exit guide panel 40, which extends from outlet 38 of housing 36 inward toward hub 32 to pass therethrough when rotary element 30 is rotated clockwise. In general, exit guide panel 40 is configured to guide a frac ball from its bay in rotary element 30 through outlet 38. In particular, exit guide panel 40 extends to hub 32 or in the vicinity thereof to make contact with an ensuing frac ball and allow it to traverse to outlet 38. As shown in FIG. 3, outlet 38 may be a chute in some cases. Such a configuration may be advantageous for extending the outlet over an open wellhead to ensure a frac ball is dropped therein. In other embodiments, however, housing 36 may include an outlet that is not a chute, but one, for example, that conforms to the circular shape of housing 36. In any case, the outlet of housing 36 may, in some embodiments, include a door, such as flappable door 42 shown in FIG. 3, such that frac balls stored in the dispenser as well as the interior components of the dispenser may be sheltered from the ambient in which the dispenser is arranged. In particular, a door on the outlet of housing 36 may shield the frac balls stored in frac ball dispenser 10 as well as the interior components of the dispenser from elements which may deteriorate the balls or the interior of the dispenser. For example, a door on the outlet of housing 36 may block fluids or moisture from entering the dispenser which could potentially disintegrate dissolvable frac balls and/or cause interior components of the dispenser to corrode. It is noted any type of frac balls may be used in frac ball dispenser 10, including those which are dissolvable and those which are not.

As set forth above, frac ball dispenser 10, mount 12, displacement mechanism 14 and control system 24 are part of a system for remotely verifying the dispensement of frac balls into an open wellhead in addition to remotely activating the dispensement of the frac balls. As such, the system may include a means for confirming a frac ball has been dispensed from the frac ball dispenser. The means may include any device which can be remotely seen and/or which can send a signal to a remote location regarding the dispensement of a frac ball into the wellhead. One manner in which to remotely verify a frac ball has been dispensed from the frac ball dispenser is to include a flag on a door of the outlet of the dispenser, such as shown by flag 44 on door 42 in FIG. 3. In this manner, when a frac ball is dispensed from the outlet of the dispenser, the door will open, causing the flag to fly up above the housing of the dispenser. In such cases, an individual may be positioned remote from the wellhead, but in line of sight of the wellhead to make the visual confirmation that a frac ball has been dispensed. Other devices which allow visual confirmation of a frac ball dispensed in the wellhead may be considered as well. For instance, in addition or alternative to frac ball dispenser 10 having a flag on door 42, an individual positioned remote from the wellhead, but in line of sight of the wellhead may include a visual aid, such as binoculars, to visually confirm a frac ball has been dropped in the wellhead. A visual aid at a location remote from the wellhead may additionally or alternatively be used to determine if any frac balls are in the dispenser and, thus, may be used to determine if the dispenser needs to be reloaded with frac balls, particularly before a frac ball is needed to be dropped into the wellhead.

In addition or alternatively, frac ball dispenser 10 may include a switch or a sensor along outlet 38, such as along exit guide panel 40 or on the interior side of door 42, which can send a signal to an output device at a location remote from the wellhead. In such cases, the location remote from the wellhead can but does not necessarily need to be within the line of sight of the wellhead. The output device may be configured to give a visual or an audible indication that a signal has been received. In yet other embodiments, frac ball dispenser 10 may include a camera or video recorder to capture the dispensement of a frac ball along or out of the output of housing 36. In such cases, the imagery may be sent to a screen at a location remote from the wellhead for visual confirmation. In any case, it may be advantageous to send an image or signal regarding the dispensement of a frac ball into a wellhead to a computer such that the receipt of the image or signal may be recorded for documentation purposes. Such a setup may be particularly advantageous for scenarios in which an individual tasked with remotely obtaining verification of a frac ball being dispensed into a wellhead is distracted and misses the signal or image sent to the output device at the remote location. In particular, if the signal or image is recorded on a computer, the individual may be able to look up the recorded information to verify dispensement of the frac ball.

In general, frac ball dispenser 10 may be configured to control the dispensement of frac balls therefrom and, more specifically, frac ball dispenser 10 may be configured such that only a single frac ball is dispensed upon the dispenser being remotely actuated by control system 24 and no additional frac balls are dispensed therefrom prior to displacement mechanism 14 moving the dispenser back to its stand-by position. FIG. 4 illustrates a cross-sectional view of the frac ball dispenser depicted in FIG. 3 without the rotary shaft coupled to the hub of the dispenser to explain the configuration of the dispenser to control the dispensement to just a single frac ball. As shown in FIG. 4, frac ball dispenser 10 includes load element 46 coupled to hub 32. Load element 46 is configured to prevent rotation of rotary element 30 unless a force exceeding a set threshold is applied to the load element. In this manner, frac balls may not be discharged from the dispenser unless a force exceeding the set threshold is applied to the load element.

Figure 4:
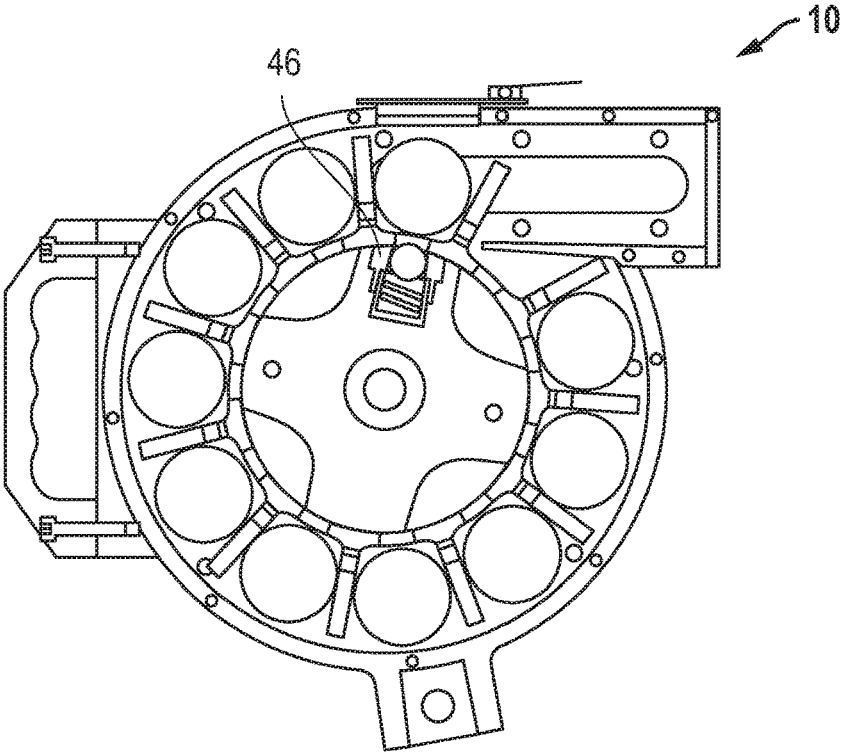
FIG. 4 is a cross-sectional view of the frac ball dispenser depicted in FIG. 3 without the rotary shaft coupled to the hub of the dispenser.
Figure 5:
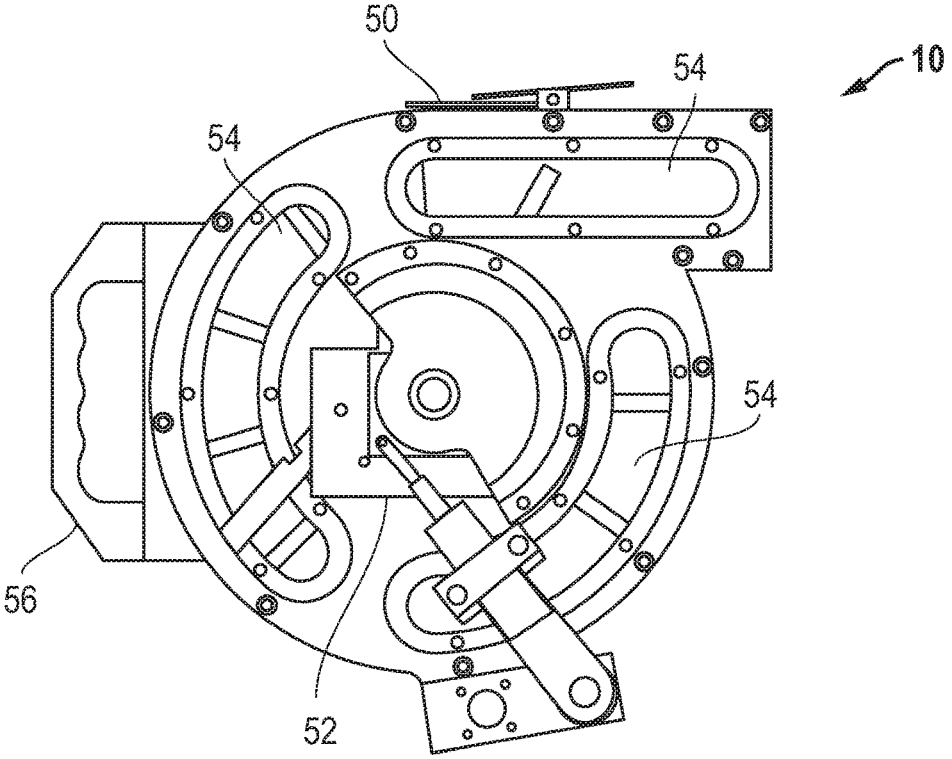
FIG. 5 is a cross-sectional view of the frac ball dispenser depicted in FIG. 3 with the frac balls removed and its side casing included.

In addition to load element 46, frac ball dispenser 10 may include ratchet assembly 52 (shown in FIG. 5) for restricting rotation of rotary element 30 to one direction, which in the viewpoint illustrated in FIG. 4 is clockwise. For operation of the system disclosed herein, displacement mechanism 14 may be remotely activated to move frac ball dispenser 10 from its stand-by position to its dispensing position a predetermined distance from mount 12. Upon reaching the predetermined distance, a force is applied by displacement mechanism 14 on load element 46 to advance rotary element 30 a predetermined degree of revolution which is sufficient to pass a frac ball on to exit guide panel 40 and out of outlet 38. Thereafter, displacement mechanism 14 is activated to retract frac ball dispenser 10 back to its stand-by position.

In general, frac ball dispenser 10 can be loaded on an as needed basis or when it is convenient. In particular, as set forth in more detail below, frac ball dispenser 10 is configured such that it may be loaded with frac balls at any time and, thus, the occurrence of the load operation is not limited to when the dispenser is empty. Furthermore, as noted below, frac ball dispenser is configured such that the dispenser may be loaded to its maximum capacity or a specific ball may be loaded for the very next drop. One manner for loading frac ball dispenser 10 may include removing its side casing, such as shown in FIG. 3, and loading a frac ball in each bay of rotary element 30. In such cases, it may be advantageous to be able to tilt frac ball dispenser 10 backward (i.e., in the direction opposite from what is shown in FIG. 3) to lessen the possibility of the frac balls falling out before the side casing is placed back on the dispenser, but such a tilt configuration is not a necessity. Another manner for loading frac ball dispenser 10 involves loading frac balls through a loading port of the dispenser, negating the removal of the side casing of the dispenser. An example configuration of frac ball dispenser 10 enabling such a loading technique is depicted in FIG. 5. In particular, FIG. 5 illustrates frac ball dispenser 10 with its side casing on to encase rotary element 30 therein. Frac ball dispenser 10 includes loading port 50 for receiving frac balls therethrough one at a time. Although loading port 50 is shown at the top of frac ball dispenser 10 near outlet 38, the position of the loading port is not so restricted. In particular, loading port 50 may be arranged along any portion of the upper half of frac ball dispenser 10 that coincides with the circumferential boundary of rotary element 30.

As noted above, frac ball dispenser 10 includes ratchet assembly 52 for restricting rotation of rotary element 30 to one direction when the ratchet assembly is engaged. To enable loading of frac balls through a loading port in housing 36, the ratchet assembly may be disengaged to allow rotary element 30 to spin in either direction. In order to avoid newly loaded frac balls from being dispensed from outlet 38 during the loading process, rotary element 30 is rotated in a direction opposite from which they are dispensed during normal operation. For example, for the embodiment depicted in FIG. 5, a frac ball may be loaded within a bay of partitions 34 and then rotary element 30 may be rotated in a counter-clockwise direction to load a frac ball in the next bay of the partitions. As frac ball dispenser 10 is loaded with frac balls and rotary element 30 is rotated in a counter-clockwise direction, the exit guide panel 40 will dictate when that the frac ball dispenser is full. In particular, the underside surface of exit guide panel 40 will impede movement of rotary element 30 upon the first loaded frac ball coming in contact with the panel.

In other cases, such as when a particular frac ball is to be loaded into frac ball dispenser 10 for the next drop, rotary element 30 may be rotated in either direction for the loading of the ball. In other embodiments, rotary element 30 may be rotated in a counter-clockwise direction, but if it is noticed that a bay has been missed during the loading operation and/or if the size or type of frac balls in the dispenser needs to be changed, rotary element 30 may be rotated in a clockwise direction, particularly to align the missed bay with loading port 50 and/or dispense the frac balls to be changed. Subsequent thereto, loading frac balls into frac ball dispenser 10 may resume by rotating rotary element 30 in a counter-clockwise direction. In any case, frac ball dispenser 10 may, in some embodiments, include one or more windows 54 exposing at least some of the partitions 34 and spacings therebetween such that the loading of the dispenser may be visually confirmed. In addition or alternatively, frac ball dispenser 10 may include one or more sensors, such as but not limited to a weight sensor in each bay, to indicate whether frac balls reside with the bays of the dispenser. In such cases, the sensor/s may be configured to send signal/s to confirm a loading process is complete and/or may send signal/s to indicate the quantity of frac balls (e.g., a number or percentage of full load) in frac ball dispenser 10. Such signal/s may be transmitted to visual or audible indicators at frac ball dispenser 10 and/or to indicators at a location remote from frac ball dispenser 10, such as the location at which the system is remotely activated to dispense frac balls during normal operation.

A method for using the frac ball dispenser and system disclosed herein may generally include mounting the frac ball dispenser to a casing of a wellhead. In some cases, a handle of the frac ball dispenser, such as handle 56 shown in FIG. 5, may be used to secure a safety harness for the dispenser to prevent the frac ball dispenser from falling if mount 12 is detached from the wellhead casing. In particular, a safety harness may be looped through handle 56 with its opposing ends secured to the wellhead casing. It is noted such a process is not limited to use with a handle. In particular, the frac ball dispenser may alternatively or additionally have any annular component for which looping a safety harness therethrough may be used. Prior to and/or subsequent to mounting the frac ball dispenser to a casing of a wellhead, the frac ball dispenser may be loaded with a plurality of frac balls. Thereafter, the frac ball dispenser may be remotely activated to dispense a frac ball therefrom. Such a process may include remotely activating the frac ball dispenser to move to a position above an open wellhead and dispense a frac ball therein. In addition, the process may include subsequently moving the frac ball dispenser to a position spaced below the open wellhead. In addition to such remotely activated frac ball dispensement, the method recited herein may include remotely obtaining verification that a frac ball was dispensed from the frac ball dispenser.

It will be appreciated to those skilled in the art having the benefit of this disclosure that this invention is believed to provide frac ball dispensers as well systems and methods employing such. Further modifications and alternative embodiments of various aspects of the invention will be apparent to those skilled in the art in view of this description. For example, although the systems and methods disclosed herein are emphasized for use with the frac ball dispenser configuration described in reference to FIGS. 3-5, the systems and methods may be used in conjunction with frac ball dispensers of other configurations. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. The term "approximately" as used herein refers to variations of up to +/−5% of the stated number.

What is claimed is:

1. A frac ball dispenser, comprising:
a rotary element, comprising:
a hub; and
a plurality of partitions extending radially from an outer periphery of the hub, wherein spacings between neighboring partitions of the plurality of partitions are each sufficient to
accommodate a frac ball;
a housing encasing the rotary element; and
a means for confirming a frac ball has been dispensed from the frac ball dispenser.

2. The frac ball dispenser of claim 1, wherein the frac ball dispenser comprises an exit guide panel extending from an outlet of the housing inward toward the hub of the rotary element, and wherein each of the plurality of partitions comprise a set of prongs with a spacing which enables the exit guide panel to pass through when the rotary element is rotated.

3. The frac ball dispenser of claim 1, further comprising a load element to prevent rotation of the rotary element unless a force exceeding a set threshold is applied to the load element.

4. The frac ball dispenser of claim 1, further comprising a ratchet assembly restricting rotation of the rotary element to one direction when the ratchet assembly is engaged with the rotary element.

5. The frac ball dispenser of claim 1, wherein the housing comprises:
a ball loading port; and
one or more windows exposing at least some of the plurality of partitions and spacings therebetween.

6. The frac ball dispenser of claim 1, further comprising a door at an outlet of the housing.

7. The frac ball dispenser of claim 1, wherein the housing comprises an output chute.

8. The frac ball dispenser of claim 1, further comprising a displacement mechanism coupled to the housing and a mount coupled to an end of the displacement mechanism opposing the housing, wherein the displacement mechanism is configured to move the housing and the encased rotary element relative to the mount.

9. The frac ball dispenser of claim 1, wherein the housing comprises an output, and wherein the frac ball dispenser comprises a displacement mechanism coupled to an end of the housing opposing the output.

10. The frac ball dispenser of claim 1, comprising one or more frac balls respectively arranged in the spacings between the neighboring partitions.

11. The frac ball dispenser of claim 1, comprising multiple frac balls respectively arranged in at least a majority of the spacings between the neighboring partitions.

12. A frac ball dispenser, comprising:

a rotary element, comprising:

a hub; and a plurality of partitions extending radially from an outer periphery of the hub, wherein spacings between neighboring partitions of the plurality of partitions are each sufficient to accommodate a frac ball;

a housing encasing the rotary element; and a ratchet assembly restricting rotation of the rotary element to one direction when the ratchet assembly is engaged with the rotary element.

13. The frac ball dispenser of claim 12, further comprising a load element to prevent rotation of the rotary element unless a force exceeding a set threshold is applied to the load element.

14. The frac ball dispenser of claim 12, further comprising a door at an outlet of the housing.

15. The frac ball dispenser of claim 12, comprising one or more frac balls respectively arranged in the spacings between the neighboring partitions.

16. The frac ball dispenser of claim 12, comprising multiple frac balls respectively arranged in at least a majority of the spacings between the neighboring partitions.

17. A frac ball dispenser, comprising:

a rotary element, comprising a hub; and a plurality of partitions extending radially from an outer periphery of the hub, wherein spacings between neighboring partitions of the plurality of partitions are each sufficient to accommodate a frac ball;

a housing encasing the rotary element;

a displacement mechanism coupled to the housing; and a mount coupled to an end of the displacement mechanism opposing the housing, wherein the displacement mechanism is configured to move the housing and the encased rotary element relative to the mount.

18. The frac ball dispenser of claim 17, wherein the housing comprises an output, and wherein the displacement mechanism is coupled to an end of the housing opposing the output.

19. The frac ball dispenser of claim 17, further comprising a door at an outlet of the housing.

20. The frac ball dispenser of claim 17, comprising multiple frac balls respectively arranged in at least a majority of the spacings between the neighboring partitions.

* * * * *